US008524039B2

(12) United States Patent
Kaule et al.

(10) Patent No.: US 8,524,039 B2
(45) Date of Patent: Sep. 3, 2013

(54) PAPERMAKING MOULD FOR PRODUCING TWO-STAGE WATERMARKS AND METHOD FOR PRODUCING THE SAME

(75) Inventors: Wittich Kaule, Emmering (DE); Karlheinz Mayer, Augsburg (DE); Bernd Stumbeck, Waakirchen (DE); Wolfgang Wensauer, Gmund (DE); Guenther Wild, Hausham (DE); Thomas Gerhardt, Munich (DE); Andreas Aigner, Valley (DE)

(73) Assignee: Giesecke & Devrient GmbH, Munich (DE)

( * ) Notice: Subject to any disclaimer, the term of this patent is extended or adjusted under 35 U.S.C. 154(b) by 1779 days.

(21) Appl. No.: 10/489,666

(22) PCT Filed: Sep. 13, 2002

(86) PCT No.: PCT/EP02/10317

§ 371 (c)(1),
(2), (4) Date: Aug. 5, 2004

(87) PCT Pub. No.: WO03/025281

PCT Pub. Date: Mar. 27, 2003

(65) Prior Publication Data

US 2004/0249754 A1 Dec. 9, 2004

(30) Foreign Application Priority Data

Sep. 17, 2001 (DE) ..... 101 45 782

(51) Int. Cl.
*D21F 1/44* (2006.01)
*D21H 11/00* (2006.01)

(52) U.S. Cl.
USPC ..... 162/110; 162/315; 162/351; 705/50

(58) Field of Classification Search
USPC ..... 162/110, 351, 315
See application file for complete search history.

(56) References Cited

U.S. PATENT DOCUMENTS

| | | | | | |
|---|---|---|---|---|---|
| 3,486,923 | A * | 12/1969 | Skofronick | 162/110 |
| 3,549,742 | A * | 12/1970 | Benz | 264/250 |
| 4,089,740 | A * | 5/1978 | Hillman | 162/304 |
| 4,514,345 | A * | 4/1985 | Johnson et al. | 264/425 |
| 4,637,859 | A * | 1/1987 | Trokhan | 162/109 |
| 5,405,500 | A * | 4/1995 | Knight | 162/103 |
| 6,214,166 | B1 | 4/2001 | Münchow | |
| 7,070,678 | B2 * | 7/2006 | Allen et al. | 162/109 |
| 2001/0018113 | A1 * | 8/2001 | Mallol et al. | 428/195 |

FOREIGN PATENT DOCUMENTS

| | | | |
|---|---|---|---|
| CA | 2 297 800 | A1 | 2/1999 |
| EP | 0 367 520 | A2 | 5/1990 |
| HU | 221 442 | B1 | 10/2002 |
| WO | WO 99 144 25 | A1 | 3/1999 |
| WO | WO9914425 | * | 3/1999 |

* cited by examiner

*Primary Examiner* — Jacob Thomas Minskey
(74) *Attorney, Agent, or Firm* — Rothwell, Figg, Ernst & Manbeck, P.C.

(57) ABSTRACT

A screen for producing two-level watermarks is produced by completely closing part of the screen with a viscous sealing compound, which is subsequently cured actively or passively. At the thus closed partial areas of the screen, paper deposit is hindered during papermaking so that the finished paper appears light in transmission in the areas. A mask is used for exactly positioning the sealing compound in the partial areas of the screen and/or for curing the sealing compound only in the given partial areas, whereby in the latter case the uncured areas of the sealing compound are washed out.

21 Claims, 1 Drawing Sheet

PAPERMAKING MOULD FOR PRODUCING TWO-STAGE WATERMARKS AND METHOD FOR PRODUCING THE SAME

BACKGROUND OF THE INVENTION

1. Field of the Invention

This invention relates primarily to a method for producing a screen for papermaking with watermarks, in particular for producing papers of value, such as bank notes, checks, identification documents and other security papers. The invention in addition relates to a mask for use in the aforementioned method, a papermaking screen to be produced by said method and a paper of value produced by means of such a papermaking screen.

2. Description of the Background Art

Papermaking is done in continuous fashion on so-called cylinder paper machines or fourdrinier paper machines, whereby paper pulp is deposited on a moving screen and consolidated to the extent that it can be removed from the screen as wet paper web for further processing such as drying, etc.

In the production of watermarked paper, a distinction is made between two-level watermarks with a strong light-dark effect and multilevel watermarks with many soft transitions between light and dark. To produce two-level watermarks, metal wires or metal moldings (so-called electrotypes) are soldered onto the screen structure to completely close the screen at these places. Thus, paper deposit is hindered in these partial areas of the screen, and thin places form in the paper that appear very light when viewed in transmission. In the production of multilevel watermarks, however, no holes of the screen are closed. Instead, a three-dimensional relief is embossed into the screen so that the paper thickness of the finished paper varies in accordance with the relief and shows soft transitions between light and dark areas in transmission.

WO 99/14425 describes an apparatus for producing absorbent paper and relates in particular to a patterned drying screen on which a paper web is transported or dried. The drying screen comprises not only a two-layer reinforcing structure but also a relief structure of cured photoresist applied thereto.

A method for applying a relief structure to a screen is described in U.S. Pat. No. 4,514,345. A thus produced screen is used for providing an existing paper layer with a three-dimensional pattern, the pattern arising by deflecting the fibers into the relief structure.

EP-A-0 367 520 describes different methods for fastening flexible watermark designs to a screen or a pressing wire. Said designs serve to produce watermarks in the later papermaking.

Unlike two-level watermarks, multilevel watermarks can only be produced on cylinder paper machines since the screens of cylinder paper machines are of rigid form. On fourdrinier paper machines, however, the screen is formed as a moving endless belt and an embossed relief for producing multilevel watermarks would be destroyed by the repeated deflection. But papermaking on cylinder paper machines is time-consuming and cost-intensive, so that embossed, multilevel watermarks are only used in the production of security-relevant papers, such as bank notes or other papers of value.

The production of two-level watermarks, although at first glance more versatile, is also problematic in many respects. Thus, soldering the metal wires or electrotypes onto the screen requires elaborate hand labor by highly skilled specialists and is therefore time-consuming and costly. Further, the firmly soldered parts are subjected to great mechanical stress on fourdrinier paper machines and not infrequently come off the screen, which has a negative effect on production reliability and product quality since the loose parts can collect in the screen and destroy the paper.

Similar problems also occur with cylinder paper machines, in particular if the two-level watermark is combined with an embossed multilevel watermark, for example to emphasize certain details, writing, coats of arms or the like by special lightness in a multilevel watermark.

Above all, the adhesion of electrotypes in the relief-embossed screen areas is critical. In addition, exact positioning of electrotypes in the relief-embossed areas of the screen is difficult. It is accordingly problematic to refasten detached parts at exactly the same position.

SUMMARY OF THE INVENTION

On these premises, the present invention is based on the problem of proposing a screen and a method for producing a screen for papermaking with a watermark wherein the means responsible for forming the watermark can be produced with little effort and in the accurate position also in embossed screen areas and withstand even strong loads.

This problem is solved according to the invention by a screen and a method for producing it having the features described herein. For use in said method, a specially designed mask is proposed in addition. Advantageous embodiments and developments of the invention are described herein.

The invention is based on the consideration that it is unnecessary to produce elevations on the screen by means of wires or electrotypes to close areas of the screen therebelow. Rather, it suffices if the screen is closed in said areas in any way, i.e. according to the invention by a sealing compound which is applied partially to the screen and closes the screen completely at these places. The purpose obtained by conventional electrotypes of hindering paper deposit in these areas and thereby producing very light places in the paper is achieved by the inventive measure to the same extent.

The sealing compound applied to the screen forms a firm bond with the screen, whereby the sealing compound preferably encloses the screen cloth completely. The sealing compound therefore does not readily come off the screen, thereby avoiding the abovementioned disadvantages of soldered electrotypes. Substances to be used for the sealing compound are ones that can be applied to the screen in a viscous state and bond firmly with the screen after additional treatment or independent curing. For example, one can use viscous adhesives, such as systems based on epoxy resins, or solder paste, which only bonds firmly with the meshes of the screen after heating. It is also possible to use radiation-curing adhesives, such as UV-curable adhesive compounds.

The invention can be used on both fourdrinier paper machines and cylinder paper machines. In the case of cylinder paper machines, the choice of material for the sealing compound is relatively uncritical due to the lower mechanical load, and relatively brittle materials can be used. For use in fourdrinier paper machines, the elasticity of the sealing compound must meet higher requirements so that the closed screen areas do not break open due to the repeated deflection. For example, materials such as rubber or other elastomers can be used in this case.

The invention is not limited to the production of two-level watermarks. A corresponding rasterization of the sealing compound will also permit multilevel watermarks to be produced. If the different gray tones of image information are assigned a certain coverage of sealing compound, more or less paper pulp is accordingly deposited in the individual areas.

Numerous ways of locally applying the sealing compound are imaginable. Thus, application can be effected e.g. by screen printing, ink dabber printing, spray technology or knife-coating. According to a special embodiment of the inventive method, a mask controls the particular application. The mask can be used for partial application of sealing compound or for partial curing of sealing compound applied over a large surface.

According to a first embodiment, the mask is positioned over the screen and the sealing compound then applied to the mask. The mask has gaps having the contour of the partial area to be closed, so that sealing compound can only flow into the screen cloth and close it in said partial area.

According to a second embodiment, the sealing compound is first applied to the screen over a large surface and then the same mask positioned thereover as in the first embodiment. Then the sealing compound is cured in the gaps of the mask so that the screen is only closed lastingly in these areas. A suitable material for activable sealing compound is for example UV-radiation-curing adhesive. Uncured sealing compound is washed out of the screen in a following step.

In a third embodiment, the sealing compound is first applied to the screen over a large surface and then covered with a mask, as in the second embodiment, but in this case the mask has the form of the partial area of the screen to be closed. The areas of the screen not covered by the mask are freed from sealing compound by the sealing compound being blown or sprayed off for example. The remaining sealing compound then cures actively or passively.

The use of masks has the advantage that they can be easily designed on the computer and produced by machine. Using the data generated on the computer, the masks can be produced e.g. by milling, laser cutting or laser milling or also by etching according to a previously produced film master. In addition, the application of sealing compound is capable of automation, so that the production of a screen for producing watermarks can be made substantially more efficient by the present invention. Since the positioning of the masks is simple and exact, the invention also has an effect on the quality of the screen and the paper produced therewith. The quality is moreover reproducible anytime when a new identical screen is produced.

It is especially advantageous to use the invention for producing an especially light watermark area (a so-called "highlight watermark") within a multilevel watermark. In this case, said areas are provided with sealing compound within the embossed screen, preferably in the apex area of the relief. A mask can be used here that has a surface structure adapted to the embossed relief of the screen, so that when the mask is laid on the screen it locks into the embossed relief of the screen. The positioning of the sealing compound relative to the multilevel watermark is thus exactly defined and completely repeatable.

The sealing compound preferably has added thereto, for further stabilization, fiber-reinforcing fillers, such as glass fibers or carbon fibers if the sealing compound is based on adhesive, or fine copper threads if the sealing compound consists of solder paste.

BRIEF DESCRIPTION OF THE DRAWINGS

In the following the invention will be explained by way of example with reference to the accompanying drawings, in which.

DETAILED DESCRIPTION OF THE INVENTION

Figure 1:
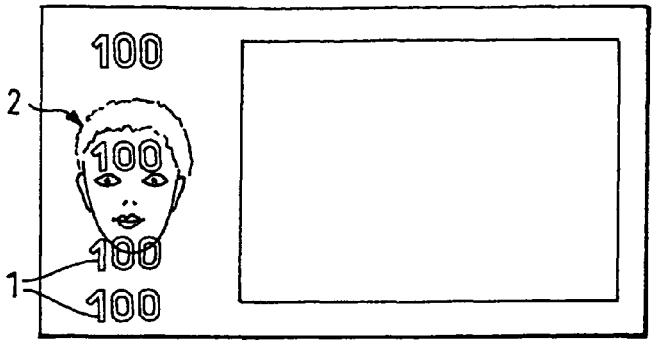
FIG. 1 shows a bank note with two-level watermarks 1 and multilevel watermark 2.

FIG. 1 shows a bank note having several two-level watermarks 1 in the form of the denomination "100" and multilevel watermark 2 in the form of a portrait. Individual two-level watermarks 1 cover multilevel watermark 2 partially or completely. Due to the multilevel watermark the paper for such a bank note is produced on a cylinder paper machine with a relief-embossed screen for producing portrait 2.

Figure 2:
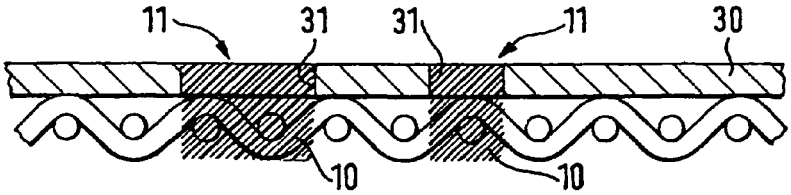
FIG. 2 shows schematically a cross section through a screen after application of sealing compound using a mask.

With reference to FIG. 2 an inventive method will be described in the following for producing screen 20 according to a first embodiment to permit production of a strict two-level watermark with the screen. Accordingly, mask 30 is positioned over screen 20, said mask having gaps 31 defining those partial areas 11 of screen 20 where screen 20 is to be closed with sealing compound 10. Sealing compound 10 is applied to mask 30, penetrating through mask 30 into screen 20 only in gaps 31 and completely closing the cloth of screen 20. This state of the inventive method is shown in FIG. 2.

In a next step, mask 30 is removed and the sealing compound either cures passively or the curing process is controlled actively, for example by supply of temperature or UV irradiation depending on the sealing compound. Alternatively, sealing compound 10 can first be cured or left to cure and only then mask 30 removed, thereby giving the contour of the two-level watermark an especially exact and sharp boundary.

It is to be taken into account that the ratios of size in FIG. 2 do not correspond to reality. The thickness of mask 30 is shown overdimensioned compared to the thickness of screen 20.

After the sealing compound has bonded with the structure of screen 20 and completely closed it in these areas, the screen is partially water-impermeable, thereby hindering paper deposit at these places during papermaking. These areas appear in transmission as very light areas compared to the surrounding paper material in paper produced with such a screen.

Figure 3:
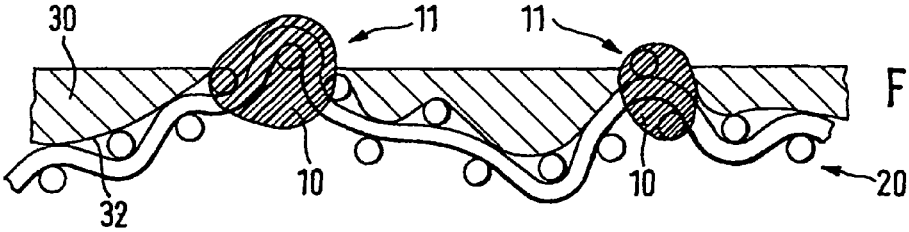
FIG. 3 shows schematically a cross section through a screen after application of sealing compound in a relief-embossed area of the screen using a mask.

While the method described with respect to FIG. 2 is suitable both for producing a screen for a fourdrinier paper machine and for a cylinder paper machine, the same method will be described in the following with reference to FIG. 3 specifically for application in a cylinder paper machine, wherein partial areas 11 of relief-embossed screen 20 are provided with sealing compound. As indicated by FIG. 3, the surface of mask 30 adjoining screen 20 has surface structure 32 adapted in the manner of a negative relief to the relief-embossed structure of screen 20 and simultaneously also to the curvature thereof, which is due to the use of screen 20 in a cylinder paper machine. Otherwise the method for closing partial areas 11 with sealing compound 10 does not differ from the method described with respect to FIG. 2. That is, mask 30 is laid on screen 20 in such a way that its surface structure 32 locks into the relief-embossed structure of screen 20. Then sealing compound 10 is applied to mask 30 so that sealing compound 10 penetrates into the screen through the gaps of mask 30 and thus encloses the screen cloth only in partial areas 11 of screen 20. After that, surplus sealing material is removed from mask 30 (the state of FIG. 3) and mask 30 taken off screen 20. Finally, sealing compound 10 is cured, or, optionally vice-versa, sealing compound 10 first cured and then mask 30 removed.

Figure 4:
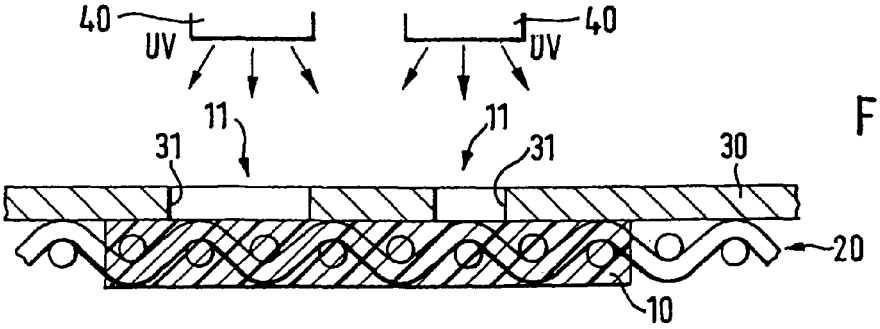
FIG. 4 shows schematically a cross section through a screen during active, partial curing of sealing compound applied over a large surface, using a mask.

With reference to FIG. 4 a second embodiment of the inventive method will be described in the following. Accordingly, in a first method step, sealing compound 10 is applied to screen 20 over a large surface so that it completely flows around and closes the screen cloth. "Over a large surface" means in this context a surface larger than partial areas 11 of screen 20 that are to be finally closed lastingly with sealing compound and that will be responsible for the later production of a watermark during papermaking. After screen 20 is impregnated with sealing compound 10, the same mask 30 that is used in connection with the embodiment of FIG. 2 is positioned thereover, and the curing of sealing compound 10 in partial areas 11 defined by gaps 31 of mask 30 is activated by UV radiation sources 40 in the shown embodiment. After curing of sealing compound 10 in partial areas 11, mask 30 is removed and the uncured areas of sealing compound 10 are washed out so that they are permeable again. The result obtained is screen 20 with the same configuration as is obtained with the method described with respect to FIG. 2.

Figure 5:
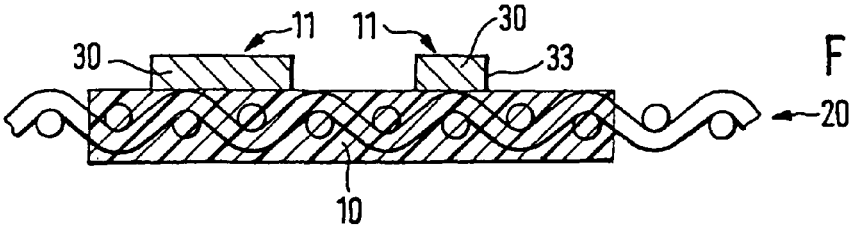
FIG. 5 shows schematically a cross section through a screen after large-surface application of sealing compound and before removal of surplus sealing compound using a mask.

According to a third embodiment of the inventive method, to be described in the following with respect to FIG. 5, sealing compound 10 is applied to screen 20 over a large surface, as described above with respect to FIG. 4, and mask 30 positioned thereover, its outside contour 33 corresponding to the form of partial area 11 to be closed. The areas of sealing compound 10 not covered by mask 30 are removed, for example blown out through screen 20, and the portion of sealing compound 10 remaining in partial areas 11 is then cured. Alternatively, curing in partial areas 11 can be done first, for example by using heated mask 30 and heat-curing sealing compound 10, and the remaining, uncured part of sealing compound 10 then removed, for example washed out.

Especially suitable substances for the sealing compound are ones that can be applied to screen 20 in the viscous state and bond firmly with the screen after their active or passive curing. It is suitable to use viscous adhesives, such as systems based on epoxy resin for example, but also solder paste as is used for example in the SMD technique and bonding firmly with the meshes of the screen only after heating. It is likewise suitable to use sealing compounds based on UV-curable adhesive. This is primarily applicable to the method described with respect to FIG. 4.

To increase the stability and bond force of the sealing compound, the latter can be mixed with fillers, for example with glass or carbon fibers in the case of adhesives and for example with fine copper threads in the case of solder paste.

Sealing compound 10 can be applied to screen 20 by screen printing, ink dabber printing, spray technology, knife-coating and other common methods, the locally exact application being preferably controlled by mask 30.

Mask 30 can be designed on a computer and produced by CAD/CAM technology automatically by milling, laser cutting or laser milling. It is also practicable to etch mask 30 according to a film master.

The invention claimed is:

1. A method for producing a screen for papermaking of a bank note, check, identification document or other security paper with a watermark by hindering paper deposit in a partial area of the screen in the form of the watermark, said method comprising the following steps:

providing a screen for a cylinder paper machine, said screen embossed to form a relief in the screen for producing a multilevel watermark; and partially applying a sealing compound to the screen so that the screen is completely closed by the sealing compound only in partial areas in the form of the watermark later to be produced during papermaking in such a way to hinder paper deposit in the partial area by the sealing compound, said partial areas comprising the apex areas of the relief in the screen.

2. A method according to claim 1, wherein the sealing compound is applied in the form of a raster.

3. A method according to claim 1, wherein the sealing compound is cured so as to produce a lasting bond between the sealing compound and the screen.

4. A method according to claim 1, wherein a mask is used in the step of applying the sealing compound or in the step of curing of the sealing compound.

5. A method according to claim 4, wherein the mask has a gap with a contour corresponding to the form of the partial area to be closed, and the sealing compound is applied to the screen through the gap of the mask.

6. A method according to claim 4, wherein the sealing compound is applied over a large surface, and the mask is used either for subsequently removing sealing compound located outside the partial area or for selectively curing the sealing compound located within the partial area.

7. A method according to claim 6, wherein the mask having a contour corresponding to the form of the partial area to be closed is disposed over the sealing compound applied over a large surface, and the area of the sealing compound not covered by the mask is removed.

8. A method according to claim 6, wherein the mask having a gap with a contour corresponding to the form of the partial area to be closed is disposed over the sealing compound applied over a large surface, the curing of the sealing compound is activated through the gap of the mask, and uncured sealing compound is subsequently removed.

9. A method according to claim 1, wherein an adhesive based on epoxy resin is selected as the sealing compound.

10. A method according to claim 1, wherein a thermally curable solder paste is selected as the sealing compound.

11. A method according to claim 1, wherein a UV-curing adhesive is selected as the sealing compound.

12. A method according to claim 1, wherein the sealing compound contains fiber-reinforcing fillers.

13. The method of claim 1, further comprising a step of embossing said screen with said relief structure prior to the step of partially applying said sealing compound.

14. The method of claim 1, wherein the step of partially applying the sealing compound comprises only applying the sealing compound in the apex areas of the relief in the screen.

15. A method for producing a screen for papermaking of a bank note, check, identification document or other security paper with a watermark by hindering paper deposit in a partial area of the screen in the form of the watermark, said method comprising the following steps:

providing a screen for a cylinder paper machine, said screen embossed to form a relief in the screen for producing a multilevel watermark; and partially applying a sealing compound to the screen so that the screen is completely closed by the sealing compound only in partial areas in the form of the watermark later to be produced during papermaking in such a way to hinder paper deposit in the partial area by the sealing compound, said partial areas comprising the apex areas of the relief in the screen, wherein a mask is selected that has a surface structure adapted to the embossed relief in the manner of a negative relief, the mask being applied to the embossed relief of the screen so that its surface structure locks in.

16. A system for carrying out the method according to claim 15 comprising a mask comprising a surface structure which is adapted in a manner of a negative relief to relief embossed into a screen for producing a multilevel watermark, and further including said screen having a relief embossed into the screen for producing said multilevel watermark and adapted to the surface structure of the mask.

17. A screen for papermaking of a bank note, check, identification document or other security paper with a watermark by hindering paper deposit in partial areas of the screen in the form of the watermark, comprising:

partial areas completely closed by a sealing compound in the form of the watermark to be produced during papermaking, in such a way to hinder paper deposit in the partial area by the sealing compound, wherein the screen is for a cylinder paper machine and the partial areas closed by the sealing compound comprise apex areas of an embossed relief surface for producing multilevel watermarks of the screen, and only said partial areas are completely closed by said sealing compound.

18. A screen according to claim 17, wherein the screen is formed by a screen cloth enclosed in the partial area by the sealing compound.

19. A screen according to claim 17, wherein the sealing compound is a cured plastic.

20. A method for producing a paper of value, wherein the paper deposit is effected on a screen according to claim 17.

21. The method of claim 17, wherein the partial areas closed by the sealing compound are only the apex areas of the embossed relief surface for producing multilevel watermarks of the screen.

* * * * *

UNITED STATES PATENT AND TRADEMARK OFFICE

CERTIFICATE OF CORRECTION

PATENT NO. : 8,524,039 B2
APPLICATION NO. : 10/489666
DATED : September 3, 2013
INVENTOR(S) : Kaule et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1998 days.

Signed and Sealed this
Fifteenth Day of September, 2015

Michelle K. Lee

Michelle K. Lee
*Director of the United States Patent and Trademark Office*